United States Patent [19]

Buritz et al.

[11] 4,176,334

[45] Nov. 27, 1979

[54] HIGH VOLTAGE TRANSFORMER AND PROCESS FOR MAKING SAME

[75] Inventors: Robert S. Buritz, Pacific Palisades; Robert D. Parker, Manhattan Beach; Jack J. Kisch, Huntington Beach; John Burnham, Los Angeles, all of Calif.

[73] Assignee: Hughes Aircraft Company, Culver City, Calif.

[21] Appl. No.: 805,662

[22] Filed: Jun. 13, 1977

Related U.S. Application Data

[63] Continuation of Ser. No. 607,513, Aug. 25, 1975, abandoned, which is a continuation-in-part of Ser. No. 477,870, Jun. 10, 1974, abandoned.

[51] Int. Cl.[2] ..... H01F 15/04; H01F 27/28

[52] U.S. Cl. ..... 336/84 C; 29/606; 336/96; 336/205; 336/206

[58] Field of Search ..... 336/84 R, 84 C, 69, 336/70, 96, 205, 206; 174/121 R, 121 SR, 124 R; 252/64, 63.2; 29/605, 606

[56] References Cited

U.S. PATENT DOCUMENTS

| | | | |
|---|---|---|---|
| 1,837,245 | 12/1931 | Wheeler | 336/84 X |
| 2,170,048 | 8/1939 | Dunning et al. | 336/84 X |
| 2,731,589 | 1/1956 | Marsh | 336/84 X |
| 2,995,685 | 8/1861 | Lord | 336/84 X |
| 3,265,998 | 8/1966 | Park | 336/84 X |
| 3,436,704 | 4/1969 | Kato et al. | 336/84 X |
| 3,566,202 | 2/1971 | Carr | 336/84 X |
| 3,643,196 | 2/1972 | Robin | 336/84 |
| 3,675,175 | 7/1972 | Dutton | 336/84 X |
| 3,979,530 | 9/1976 | Schwider et al. | 252/64 |

FOREIGN PATENT DOCUMENTS

| | | | |
|---|---|---|---|
| 976786 | 4/1964 | Fed. Rep. of Germany | 336/84 |
| 1513911 | 4/1969 | Fed. Rep. of Germany | 336/84 |
| 211138 | 8/1940 | Switzerland | 336/84 |

*Primary Examiner*—Thomas J. Kozma

*Attorney, Agent, or Firm*—Booker T. Hogan, Jr.; W. H. MacAllister

[57] ABSTRACT

High voltage solid dielectric insulation system transformers and inductors have been designed and produced by a process which results in a substantial improvement in the high voltage, size and weight characteristics of magnetic components prepared therefrom.

11 Claims, 3 Drawing Figures

HIGH VOLTAGE TRANSFORMER AND PROCESS FOR MAKING SAME

This application is a continuation of application Ser. No. 607,513, filed Aug. 25, 1975, which is a continuation-in-part of prior copending application Ser. No. 477,870, filed June 10, 1974. These prior filed applications have now been abandoned.

RELATED APPLICATIONS

In U.S. application Ser. No. 461,071, filed April 15, 1974, by Alfred W. Schwider et al of the assignee, which issued as U.S. Pat. No. 3,979,530 on Sept. 7, 1976, a new insulation system, useful for the fabrication of high voltage transformers, capacitors, and power supply encapsulation and insulation systems, was disclosed. This system is a key element of the present design and process.

BACKGROUND OF THE INVENTION

1. Field of the Invention

The invention is concerned with the design and fabrication of a family of high voltage all solid dielectric magnetic components which are lightweight and reliable.

2. Description of the Prior Art

High-voltage components and systems for airborne or satellite applications have usually relied upon dielectric-liquid-filled insulation, both within the components and systems and between points of high potential and ground. The dielectric liquids which have been used are varied, ranging from hydraulic fluid in some aircraft to ordinary transformer oil in some satellites. The liquid-filled insulation is very well understood, as it was first used in electric power distribution systems in the late 1800's. Because of the large body of experience which has accumulated since that time, the design of very reliable systems is relatively artless. Recent technology has introduced refinements in the liquids used, including inhibitors to control ionic migration, and in the solid portions of the liquid filled system, including purer kraft paper and a number of new plastic films.

Nevertheless, a liquid-filled component or system does present some disadvantages which must be recognized. In a system where the liquid is circulated and used as a coolant in addition to a dielectric, one has the extra weight and volume of the pumps, radiators, piping, containers, and fluid. Problems of contamination in such systems are well known. For separate components, the principal problems are the weight and size of the container and liquid, and the effectiveness of the bellows assembly. In all cases, but particularly for satellite systems, there is the problem of liquid leakage from the system contaminating the other parts of the spacecraft. Finally, the pure fluids used must be operated at relatively low electric stresses; high stress operation is obtained by wicking or filling the liquid, or by the use of barrier insulation.

If it were possible to build these high-voltage components and systems with a liquid-free insulation, some of the above problems might be solved. In particular, it might be expected that the solid-insulated systems would lighter, smaller, and easier to handle, due to the lack of case, bellows, and oil. The intrinsic dielectric strength of a solid insulation is much higher than a liquid, so if design and processing were just right it might be possible to achieve further reductions in size and weight.

Attempts to build components and systems using solid dielectrics usually begin with the filling of components designed for liquid dielectrics with some potting material. Unless the design of the liquid system has been unusually conservative, these attempts are short-lived, with the failure being arcing and decomposition of the insulation, if not at sea level then at operating altitude. This method, one would intuitively guess, will not be fruitful.

A second method commonly employed in the design of solid-insulated high-voltage components and systems is to pot a system designed to work in air at sea level. If this approach works at all, it usually results in a very large, heavy system. Failures are slower to develop than in the first case, but manifest themselves in the same way. In addition, stresses due to the thermal expansion of the encapsulant tend to damage components, and thermal gradients due to the large body of insulation produce overheating.

The method which seems to be current practice today is to pick a potting material, and then design to its dielectric strength figure using a large margin of safety. The resulting components and systems are life-tested at varying stresses in statistically significant quantities, and the design which meets the required lifetime is picked. The method is arduous, but seems to result in useful, if overweight, parts and systems.

Another way of designing high-voltage components is what one might call the phenomenological approach. To begin with, consider the well-known failure mechanism in high-voltage insulation - corona (by which we mean partial internal discharges). (Kreuger, F. H., *Discharge Detection in High Voltage Equipment.* New York: American Elsevier Publishing Company, Inc., 1964.) Corona consists basically of electrical discharges within voids in the insulation; the discharges carbonize and enlarge the void, which leads to bigger discharges, which lead to a bigger void, which leads ultimately to complete failure. This seems to be the only important failure mechanism in high-voltage insulation, though it may have numerous variants in form. To build a component or system with very long life, one clearly must use an insulation in which no corona occurs. Since corona is produced by an electric field acting in voids in the insulation, it is necessary to make the voids small and few enough, or the electric field small enough (or both) so that no corona occurs.

The art of field control as applied to electrical power distributor systems is known. (Alston, L. L., ed., *High Voltage Technology.* London: Oxford University Press, 1968.) However, this art has not been applied to the fabrication of small transformers for high voltage applications. It is the practice of the art to increase the insulation thickness within and surrounding the component to reduce peak electrical stresses to below the corona inception stress. This practice has the disadvantage of resulting in a design having greater than required insulation thickness.

Applicants know of no instances where small, all solid dielectric, magnetic components have been built which are capable of handling high voltages at significant power levels. If a criterion of excellence is the specific weight of a component in pounds per kilowatt, transformers made according to the teachings of this invention are between two and five times better than the current state of the art.

SUMMARY OF THE INVENTION

A new design and method of preparing all solid-dielectric high voltage magnetic components is disclosed. The invention utilizes conductively coated electric stress-limiting corona shields, porous barrier insulation, and a unique polyester-filled epoxy resin electrical insulation system to achieve results which are new, useful, and much improved over prior art.

The invention has led to the fabrication of high voltage magnetic components which are compact, light weight, and low cost. To achieve these qualities, the components have controlled electric fields and field divergences, and use insulation that exhibits a very high corona inception stress level.

Inductors and transformers have been prepared via the techniques disclosed in this invention. The invention lends itself to the fabrication of transformers that have multiple secondaries and which are capable of sustained high voltage operations with extremely high reliability.

BRIEF DESCRIPTION OF THE DRAWINGS

The drawing contains three figures.

DESCRIPTION OF THE INVENTION

Figure 3:
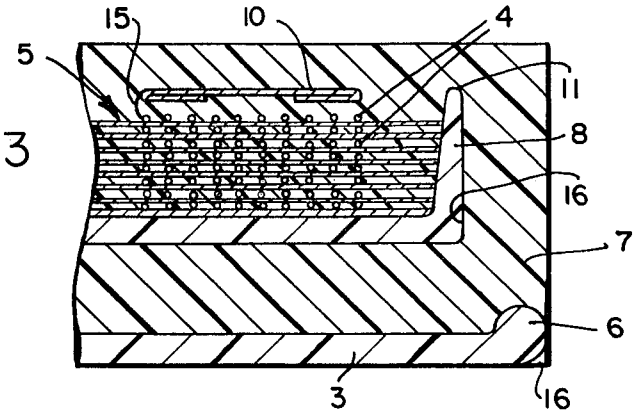
FIG. 3 is an expanded cross section view of a portion of the primary from FIG. 1.

Two approaches have been taken to develop high-voltage magnetic components having long reliable service life. The first is to control the electrical stresses which induce corona within the component and the second is to develop a superior insulation system which will not exhibit corona until very high stress levels are reached.

An electrical insulation system capable of very high corona inception stress levels was disclosed in U.S. Pat. No. 3,979,530, issued Sept. 7, 1976, by A. W. Schwider et al. The teachings of this disclosure are hereby incorporated by reference into this application.

Having developed an insulation system with very good properties, we then concentrated upon keeping the electrical field at values such that the voids remaining will not break down and degrade the insulation. To do this we employ structures and configurations to control the electrical fields everywhere so that the compactness in size and weight promised by the excellent insulation developed above is not lost.

Very simply, the radii of all conductors at high voltage which are exposed to conductors at other potentials including ground are controlled by the designer. If the magnetic part of a design dictates a conductor of small radius, shields of large radius are employed. The principal field control method in high voltage transformers is the use of conductive shields. The basic approach is as follows: the primaries are wound on a former tube (compatible with the resin system) and the leads are brought out to terminals on the end. Over these windings is slipped a conductive shield consisting of a tube with enlarged rings on the end. A shorting link is, of course, avoided by a non-conductive strip. This shield is electrically connected to a primary. Over this shield is wound porous barrier insulation (less than 50 mils for a 10 kv unit) and over the insulation are placed individual secondary shields for the high voltage secondary windings. Each secondary winding is connected to its individual shield. The size of the annular rings at the ends of the shield can be calculated knowing the corona inception voltage (CIV) of the insulation so that this CIV is not exceeded. Thus, instead of 10 kv being stood between a 26 gauge primary wire and a 39 gauge secondary wire, it is stood between the primary ring and the secondary ring, both of much larger radius than the wires. This means that the peak electric field, related approximately inversely to the wire diameter, is much smaller in the latter case than in the former. The resulting structure is smaller than conventional designs and nowhere is the field greater than the CIV.

Each secondary winding may have an outer shield made typically of copper sheet with formed edges, placed over the outside of the winding, and electrically connected to it. The purpose of such a shield is to reduce the electric field stress between the fine (small diameter) wires of the secondary and any conductors at other potentials external to the transformer.

The primary and secondary shields are typically made from epoxy-glass laminates conductively coated all over with the exception of a thin strip running parallel to the axis on the inside and outside. Other lightweight materials may be used. The key is to design the ends of the shields such that the size is related to the known CIV of the insulation. During the development phase, the CIV may be ascertained from experimental tests of prototype systems. Working stresses slightly below the usual CIV are selected for design purposes. The shape of the rings at the ends of the shields hold the peak electrical stresses to a design value near the average electrical stress and enable the operation of the structure at a higher average stress. The voltage gradient from primary to secondary is borne entirely by the insulation between the shields. This insulation has a very high corona inception stress level so that the distance between the shields may be much smaller than conventional systems.

During the processing of the assembly, the porous barrier insulation material centers the secondary shield upon the inner and holds it firmly in place, thus eliminating the need for tooling and fixtures. The entire assembly is vacuum formed and potted in a single step. Since the assembly of the shields is so easy and since the impregnation of the interwinding insulation may be done at the same time as the impregnation of the secondary, little cost is added.

It is possible to use these techniques to effectively insulate entire functional modules for spacecraft or airborne application where the pressure of the gas surrounding the module is allowed to vary. Ordinarily, one would expect to find breakdown at some pressure (depending upon the configuration), and this breakdown may actually damage the module or may generate unacceptable electrical interference. The module is assembled on a nonconductive substrate. Interconnections between components are made with care so that no sharp points or other field concentrators are present. All solder connections are carefully rounded and output wires are brought out through especially designed low corona feed-throughs. This whole assembly is encapsulated with a thin (25 mils) coating of the insulation system described previously. Finally, a ground plane is applied over the entire outside surface using a conductive filled-epoxy paint.

Examples of magnetic components utilizing the design techniques described above are shown below.

EXAMPLE I

A high voltage filament transformer was prepared as follows: A primary for 25 volt 10 kHz square wave operation was wound about a cylindrical forming tube, wrapped with a porous barrier insulation, and inserted into a primary shield two inches in length and 0.818 inches inside diameter with an end radius of 0.0275 inch. A secondary was wound upon a secondary shield having end rings with radii of 0.062 inch, an inside diameter of 1.180 inches, and a length of 1.320 inches. The primary shield was wrapped with a layer of porous barrier insulation and inserted into the secondary shield. The resulting assembly was placed in a vacuum chamber and impregnated with an epoxy resin electrical insulation system. The entire assembly was then pressurized and allowed to cure. Following cure, the monolithic primary/secondary coil was assembled onto a ferrite core, of double C configuration with cylindrical legs. In operation, the transformer produces 8V at 2A from a 25V 10 kHz square wave. In addition, the transformer supports a 10 kVDC bias between primary and secondary. It is used to power the filament and cathode of a traveling wave tube in a radar. It operates in a variable pressure environment and is completely self-contained. This transformer is tested and the AC CIV between the primary and secondary of production units is required to be greater than 15.6 kV rms at 60 Hz. Units similar to this transformer have been used in radar breadboard and brassboard for the Atlas II radar system, and have withstood more than 1,000 hours of operation without failure.

EXAMPLE II

A high voltage power transformer having three high voltage secondaries and a single primary was prepared as follows: A primary was prepared by winding enameled magnet wire around a cylindrical forming tube. This primary was wrapped with porous barrier insulation and inserted into a primary shield having end rings. The dimensions of this shield were: length—3.820 inches; inside diameter—1.180 inches; and end ring radius—0.025 inch.

The first and second secondaries were each wound about a separate shield having the following dimensions: length—0.920 inch; inside diameter—1.310 inches; and end radius—0.025 inch. The third secondary was wound about a secondary shield having the following dimensions: length—1.760 inches; inside diameter—1.310 inches; and end ring radius—0.025 inch. The secondary shields were 0.025 inch thick and each contained end rings of 0.025 inch radii whose projection in the radial direction was approximately 0.145 inch. An outer shield fabricated from copper sheeting was wrapped about each secondary. The first and second secondaries contained outer shields of the following dimensions: width—0.2 inch; circumference—5 inches; edge radius—0.005 inch; and end corner radius—0.03 inch. Two shields per secondary were required. The third secondary contained outer shields of the same dimensions as those used in the first and second secondaries, except for the following: width—0.5 inch and end corner radius—0.06 inch. Each secondary was mounted onto the primary shield (containing the primary) which had been wrapped with a porous barrier insulation. Similar insulation in ring form was placed between adjacent secondary shields. The entire assembly was placed in a vacuum chamber and vacuum impregnated with an epoxy resin system as described above. The entire unit was cured under pressure. Following cure, the monolithic primary/secondary coil was assembled onto a ferrite core of double C configuration with cylindrical legs. Two such coil units, one on each leg, are used in a single transformer.

Figure 1:
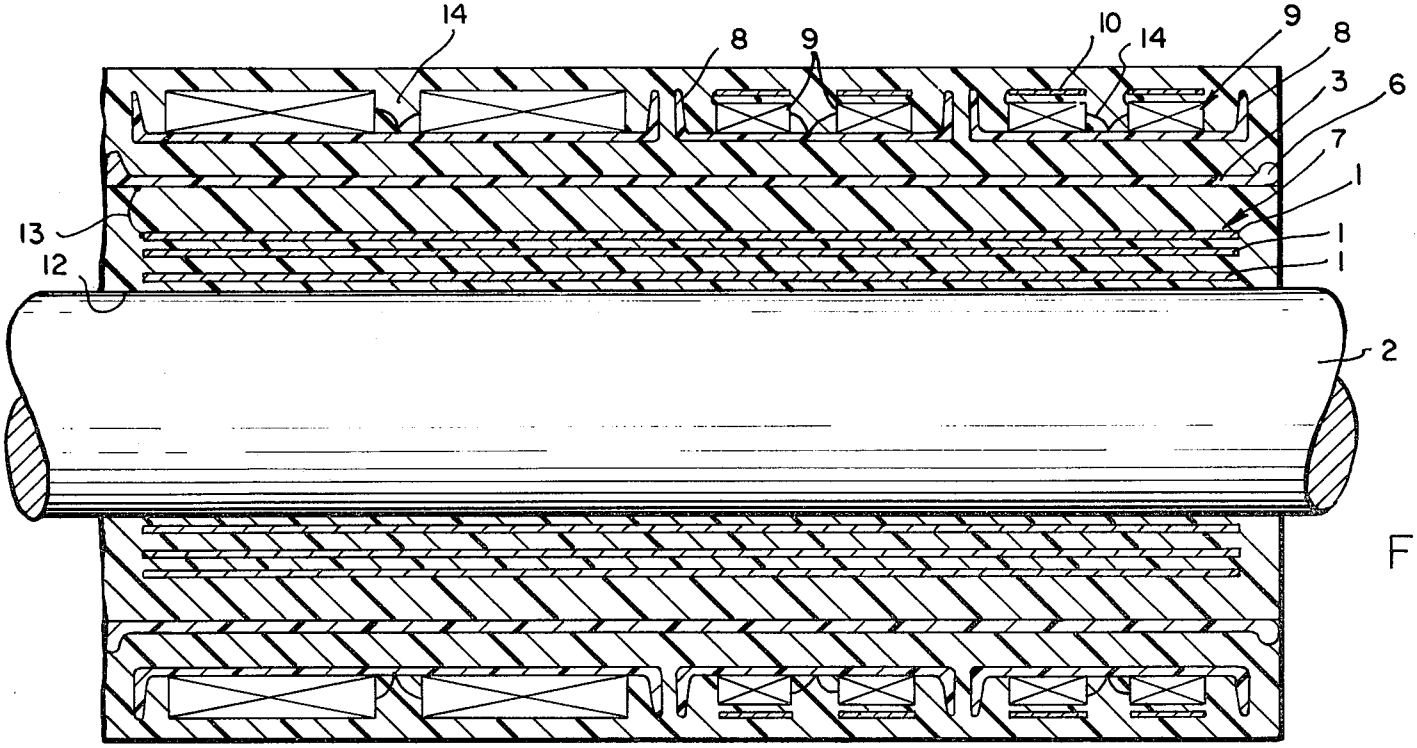
FIG. 1 is a cross section view of a multiple-secondary transformer.

This transformer produces three secondary voltages, as follows:

Secondary 1—4875 volts, 30 milliamperes
Secondary 2—4875 volts, 30 milliamperes
Secondary 3—6600 volts, 150 milliamperes The first secondary, in addition, has a −5 kVDC bias, while the second and third secondaries operate with a −10 kVDC bias. Primary power is a 190 volt 10 kHz square wave. It is the main high voltage power transformer for the Atlas II radar, supplying collector, grid, and cathode of the TWT. The transformer is required to have a CIV greater than 20 kVac between each secondary and the primary. The transformer supplies 1300 watts, is 99% efficient and weighs 2.85 pounds. On a pounds-per-kilowatt basis, this transformer is 3 to 5 times better (i.e., lighter) than present state of the art. A unit typical of this transformer has run 440 hours in the Atlas II system. A schematic section-view of a single core leg with its associated monolithic primary/secondary coil is shown in FIG. 1. The primary winding (1) is wound on the forming tube (2). The primary shield (3) is electrically connected (13) to the primary, and projects further in the axial direction than the primary.

Figure 2:
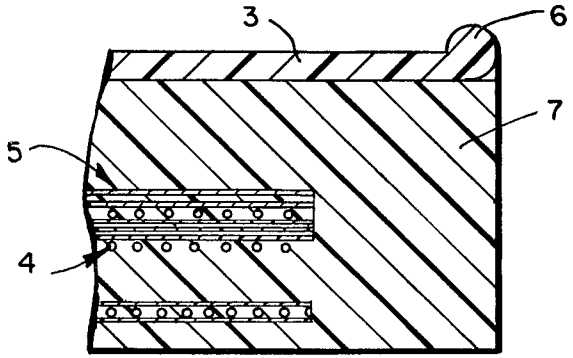
FIG. 2 is an expanded cross section view of a portion of a single secondary shield from FIG. 1.

The primary and its shield are shown in detail in FIG. 2. Here the individual conductors (4) and the porous barrier interlayer insulation (5) are visible. The primary shield (3) has rounded annular ends (6) designed to reduce the peak electric field stress.

The major portion of the electric field stress is developed across the interwinding insulation (7), as seen in FIG. 1. Over this insulation, composed of epoxy impregnated polyester mat, are mounted the three secondary shields (8). Each secondary winding (9) is split into two parts, and the center is electrically connected (14) to the shield (8). Above each half-winding is an outer shield (10) which is electrically (15) connected to the top end of its half-winding.

A detailed view of a part of a single secondary can be seen in FIG. 3. In this view, the individual conductors (4), interlayer insulation (5), and outer shields (10) can be clearly seen. The interwinding insulation (7), primary shield (3) and conductive coatings are also shown. Note the radii on the corners of the secondary shield (11) and the end of the primary shield (6). It is at these points that the peak electric field stress is seen, and so these radii must be carefully controlled.

The core (12), upon which the coil is mounted, is shown in FIG. 1 in the center of the section. Each transformer of this type consists of two such monolithic coils and a single core, which completes the magnetic circuit through them.

We claim:

1. A small, lightweight, high voltage transformer utilizing all solid dielectric insulation materials having a specific weight of less than three pounds per kilowatt of transformer power comprising a primary transformer winding disposed about a porous barrier insulation material impregnated with a dielectric resin, a conductively coated epoxy-glass laminate primary shield electrically connected to said primary winding and extending beyond said primary winding in the axial direction and having rounded ends which project in a radial direction away from said winding and maintained in a predetermined spaced relationship to said winding by said impregnated porous barrier insulation material, a conductively coated epoxy-glass laminate secondary shield maintained in a predetermined spaced relationship to said primary shield by said impregnated insulation material and electrically connected to a secondary transformer winding disposed about said secondary shield and an encapsulation system comprised of said dielectric resin which completely surrounds and encapsulates said transformer.

2. The transformer of claim 1, wherein said primary shield projects in the axial direction further than the windings of said primary winding and secondary shield and has rounded ends with radii substantially larger than the radii of said winding wires which project in a radial direction away from said primary coil, wherein said secondary shield projects in the axial direction further than the ends of said secondary coil and has radial components with rounded ends with radii substantially larger than the radii of said secondary winding wires which project in the radial direction further than said secondary winding.

3. The transformer of claim 1, wherein said insulation material is comprised of a chopped-polyester fiber mat impregnated with a resin.

4. The transformer of claim 1, wherein said insulation material is comprised of a chopped-polyester fiber mat impregnated with a resin comprised of a mixture of butyl-glycidyl ether and the reaction product of bisphenol-A and epichlorohydrin crosslinked with an amine hardener.

5. The transformer of claim 4, wherein said resin is a mixture of 11% butyl-glycidyl ether and 89% said reaction product.

6. The transformer of claim 4, wherein said amine hardener is comprised of menthane diamine, metaphenylene diamine and benzyldimethylamine.

7. The transformer of claim 4 wherein said primary shield projects in the axial direction further than the windings of said primary winding and secondary shield and has rounded ends with radii substantially larger than the radii of said winding's wires which project in a radial direction away from said primary coil and wherein said secondary shield projects in the axial direction further than the ends of said secondary winding and has radial components whose rounded ends have radii substantially larger than the radii of said secondary winding wires which project in the radial direction further than said secondary winding.

8. A transformer of claim 1 having several secondary shields arranged about said primary shield, wherein each shield is electrically connected to one secondary winding and is insulated from other secondary shields and said primary shield by said insulation material.

9. A transformer of claim 8 wherein said insulation material is comprised of a chopped-polyester fiber mat impregnated with a resin comprised of a mixture of butyl-glycidyl ether and the reaction product of bisphenol-A and epichlorohydrin crosslinked with an amine hardener.

10. A transformer of claim 9 having multiple secondary windings wherein each secondary winding is electrically connected to an outer corona shield having rounded edges which extend beyond said secondary in the axial direction and wherein each secondary unit, comprising an outer corona shield, a secondary shield, and a secondary winding electrically connected together, is insulated from other secondary units and said primary shield by said electrical insulation materials.

11. A transformer of claim 10 which includes a core whereby electromagnetic coupling between said primary windings and said secondary windings is achieved and a flux path is contained.

* * * * *